US006095241A

United States Patent [19]

Bland et al.

[11] Patent Number: 6,095,241

[45] Date of Patent: Aug. 1, 2000

[54] COUPLING DEVICE FOR A DRIVE ASSEMBLY

[75] Inventors: Linden H. Bland, Edmonton; David W. Campbell, Ardrossan, both of Canada

[73] Assignee: Campbell Industries Ltd., Edmonton, Canada

[21] Appl. No.: 09/095,041

[22] Filed: Jun. 10, 1998

[30] Foreign Application Priority Data

Jun. 9, 1998 [CA] Canada ..... 2240058

[51] Int. Cl.[7] ..... E21B 33/03

[52] U.S. Cl. ..... 166/68.5; 166/78.1

[58] Field of Search ..... 166/78.1, 68.5

[56] References Cited

U.S. PATENT DOCUMENTS

| | | | |
|---|---|---|---|
| 2,471,198 | 5/1949 | Cormany . | |
| 2,595,434 | 5/1952 | Williams . | |
| 2,604,850 | 7/1952 | Carlin et al. | 166/68.5 |
| 2,630,181 | 3/1953 | Solum . | |
| 2,693,238 | 11/1954 | Baker . | |
| 3,891,031 | 6/1975 | Ortiz . | |
| 4,087,211 | 5/1978 | Pochyly . | |
| 4,089,624 | 5/1978 | Nichols et al. . | |
| 4,314,611 | 2/1982 | Willis . | |
| 4,372,379 | 2/1983 | Kulhanek et al. | 166/68.5 |
| 4,603,592 | 8/1986 | Siebold et al. | 74/41 |
| 4,631,970 | 12/1986 | Pauls | 74/44 |
| 5,139,090 | 8/1992 | Land | 166/369 |
| 5,427,178 | 6/1995 | Bland | 166/78 |
| 5,429,188 | 7/1995 | Cameron et al. | 166/78 |
| 5,551,510 | 9/1996 | Mills | 166/68 |

OTHER PUBLICATIONS

Diagrams of vorious models of drive assembly entitled "Griffin P.C. Pumps" undated (2 pages).

Corod, An EVI Tools Division, Catalogue entitled "Rotalift™ Welhead Drive Units" dated Aug., 1996 (6 pages).

*Primary Examiner*—Hoang Dang

*Attorney, Agent, or Firm*—Terrence N. Kuharchuk

[57] ABSTRACT

A device for connection to a wellhead for coupling a drive assembly for a downhole pump with an apparatus having a rotatable member for driving the apparatus. A rotatable first shaft, having a first end and a longitudinal axis, is associated with the drive assembly such that the first shaft is rotated thereby. A rotatable connector, having driven and drive ends, connects the first shaft with the rotatable member such that rotation of the first shaft rotates the connector. The driven end connects with the first end of the first shaft. The drive end connects with the rotatable member. A rotatable coupler, having driven and drive ends and a longitudinal axis, connects the first shaft with the connector. The driven end of the coupler connects with the first end of the first shaft. The drive end of the coupler connects with the driven end of the connector. The longitudinal axis of the first shaft is substantially coaxial with the longitudinal axis of the coupler such that the driven end of the connector rotates substantially coaxially with the first shaft.

19 Claims, 8 Drawing Sheets

Figure 6
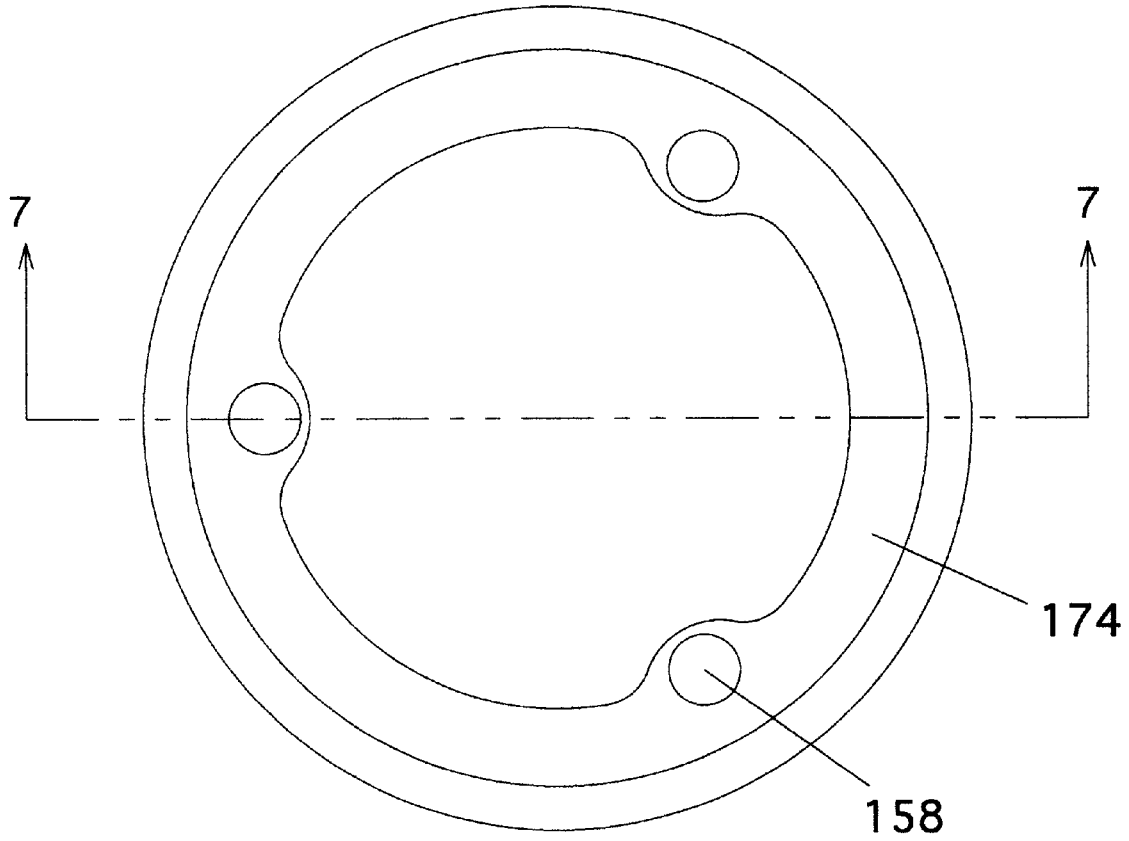
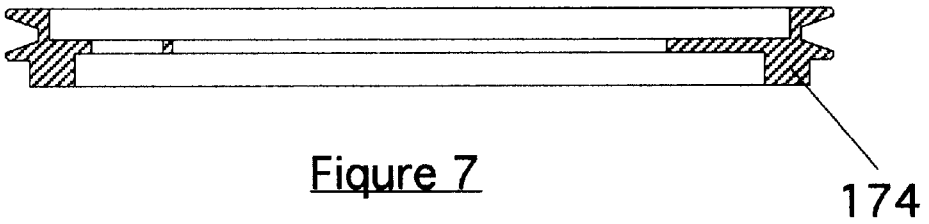
Figure 7

COUPLING DEVICE FOR A DRIVE ASSEMBLY

FIELD OF INVENTION

The present invention relates to a device for connection to a wellhead for coupling a drive assembly for a downhole pump with an apparatus having a rotatable member for driving the apparatus. The drive assembly is comprised of a rod string suspended in the wellhead, wherein the drive assembly drives the downhole pump. More particularly, the device couples the drive assembly with the apparatus such that the drive assembly rotates the rotatable member to drive the apparatus. The apparatus is preferably comprised of a tubing rotator for rotatably suspending a tubing string in a wellbore such that the drive assembly drives the tubing rotator in order to rotate the tubing string in the wellbore.

BACKGROUND OF INVENTION

A wellbore of a well is typically completed by cementing a casing string in at least the upper portion of the wellbore. The wellhead of the well typically includes a casing head or casing bowl engaging or otherwise mounted to the casing string at the surface. The remainder of the wellhead, which may comprise any number of further elements or apparatuses, is then mounted to or upon the casing bowl. Where the wellhead does not include a casing bowl, the upper end of the casing string itself may be used to support the wellhead.

Further, the wellhead typically includes a tubing hanger, or other support mechanism, connected to or engaging an upper end of a tubing string contained within the wellbore. The tubing hanger thus acts to support or suspend the tubing string within the wellbore at the surface of the well. As well, a reciprocating rod string or a rotating rod string, supported by the wellhead, is typically run through the tubing string for production of the well.

In particular, many wells today utilize progressive cavity pumps to lift fluids from the bottom of the production well to the surface. The progressive cavity pump system includes a downhole pump and a sucker rod string supported by the wellhead in the wellbore. Specifically, the downhole pump is driven by a drive assembly or top drive forming part of the wellhead, which drive assembly drives the downhole pump by rotation of the rod string. Production fluids are transported to the surface through the tubing string.

The wellhead may also include a tubing rotator. Tubing rotators are used in the industry to suspend and rotate the tubing string within the wellbore. By rotating the tubing string, typical wear occurring within the internal surface of the tubing string by the reciprocating or rotating rod string is distributed over the entire internal surface of the tubing string. As a result, the tubing rotator may prolong the life of the tubing string. Further, the constant movement of the tubing string relative to the rod string may inhibit or reduce the buildup of wax and other materials within the tubing string.

When a tubing rotator is in use in the wellhead, the tubing hanger is typically comprised of a swivel tubing hanger or swivel dognut assembly. The swivel tubing hanger is comprised of a rotatable mandrel, which is connected to and suspends the tubing string within the wellbore, and a drive system for rotating the mandrel which results in the rotation of the tubing string. The drive system is conventionally comprised of a system of gears which engages the mandrel either directly or indirectly to cause it to rotate. More particularly, the swivel tubing hanger includes a driven gear which is engaged with a drive gear associated with a rotatable member. The driven gear and the drive gear comprise the drive system of the tubing rotator which causes the tubing string connected to the swivel tubing hanger to be rotated within the wellbore.

In order to provide even distribution of the wear on the tubing string, the tubing string is preferably turned automatically on a continuous basis. As well, it may be preferred that other apparatuses associated with the wellhead similarly be operated on an automatic basis. Several mechanisms or means for operating tubing rotators on a continuous basis are known.

For instance, tubing rotators are typically driven by an alternating current or direct current electric motor or by a hydraulic motor depending upon the energy source available at the well site. Where the progressive cavity pump drive assembly is driven by an alternating current electric motor, the tubing rotator is usually driven by a separate alternating current electric motor. Where alternating current is not available, the progressive cavity pump drive assembly may be driven by a hydraulic motor that is powered by hydraulic fluid received from a pump driven by an internal combustion engine. In this case, the tubing rotator can also be driven by a hydraulic motor utilizing hydraulic fluid from the same source or by a 12 volt direct current electric motor connected to the battery of the internal combustion engine. One example is shown in U.S. Pat. No. 2,630,181 issued Mar. 3, 1953 to Solum, which describes an apparatus for continuously rotating the tubing string which is operated by hydraulic pressure.

However, the means for operating the tubing rotator are preferably driven by, and combined with, the producing action of the wellhead, as shown in U.S. Pat. No. 2,471,198 issued May 24, 1949 to Cormany, U.S. Pat. No. 2,595,434 issued May 6, 1952 to Williams, U.S. Pat. No. 5,139,090 issued Aug. 18, 1992 to Land and U.S. Pat. No. 2,693,238 issued Nov. 2, 1954 to Baker. These patents all provide for a tubing rotator which is connected to a wellhead having a reciprocating rod string attached to a walking beam. The tubing rotator is continuously driven by the reciprocating action or movement of the walking beam. However, the operating means described in these patents may not always be useful given that many wellheads today use a rotating rod string for production of the well rather than a reciprocating rod string and walking beam structure.

U.S. Pat. No. 5,427,178 issued Jun. 27, 1995 to Bland continuously drives the tubing rotator by the action of a rotating rod string. More particularly, the Bland patent describes an adaptor for connection to the rotating rod string for automatically driving a tubing rotator or other apparatus. The adaptor operatively connects the rotating rod string to the means for rotating the tubing string such that rotation of the rod string operates the rotating means in order to rotate the tubing string within the wellbore.

The adaptor of Bland is comprised of: a sleeve that is mountable about the rotating rod string such that rotation of the rod rotates the sleeve; a shaft having an end engaged with the sleeve such that rotation of the sleeve rotates the shaft; and an adaptor housing, mounted about the sleeve, for supporting the end of the shaft such that the sleeve is rotatable within the adaptor housing. More particularly, the end of the shaft engages an outer surface of the sleeve in a manner such that the longitudinal axis of the shaft intersects the longitudinal axis of the sleeve. In the preferred embodiment, the axis of the shaft is perpendicular to the axis of the sleeve. Further, the end of the shaft comprises a pinion which engages a crown gear on the outer surface of the sleeve. Therefore, the housing is mounted about the sleeve in order to support the end of the shaft (being the pinion) in proper engagement with the crown gear of the sleeve.

The adaptor of the Bland patent, described for operatively connecting the rotating rod string to the tubing rotator or other apparatus, may not be desirable or economically feasible for some applications given the specific structure of the adaptor as described above.

Therefore, there is a need in the industry for an improved device for connection to a wellhead for coupling a drive assembly for a downhole pump with a tubing rotator or other apparatus associated with the wellhead, the apparatus having a rotatable member for driving the apparatus.

SUMMARY OF INVENTION

The present invention is directed at a device for use in association with a well having a drive assembly for a downhole pump. The device provides a link between the drive assembly and an apparatus so that the apparatus can be driven by the same drive assembly that drives the downhole pump.

In a broad aspect, the device comprises a rotatable first shaft which is either part of the drive assembly or which is connectable either directly or indirectly with the drive assembly. The first shaft is coupled with a rotatable connector which in turn may be coupled with the apparatus to be driven so that rotation of the first shaft results in driving of the apparatus. Any form of coupling may be used to couple the first shaft to the connector or to couple the connector to the apparatus, so long as the coupling results in the transmission of rotation from the first shaft to the connector and then to the apparatus.

In one aspect, the invention is a device for connection to a wellhead for coupling a drive assembly for a downhole pump with an apparatus having a rotatable member for driving the apparatus, wherein the drive assembly comprises a rod string suspended in the wellhead and wherein the drive assembly drives the downhole pump, the device comprising a rotatable first shaft having a first end, a second end and a longitudinal axis extending therebetween, wherein the first shaft is associated with the drive assembly such that the first shaft is rotated thereby, a rotatable connector for connecting the first shaft with the rotatable member of the apparatus such that rotation of the first shaft rotates the connector and drives the apparatus, the connector comprising a driven end for connecting with the first end of the first shaft and a drive end for connecting with the rotatable member of the apparatus, and a rotatable coupler having a driven end, a drive end and a longitudinal axis extending therebetween for connecting the first shaft with the connector, wherein the driven end of the coupler is connected with the first end of the first shaft, wherein the drive end of the coupler is connected with the driven end of the connector, and wherein the longitudinal axis of the first shaft is substantially coaxial with the longitudinal axis of the coupler such that the driven end of the connector rotates substantially coaxially with the first shaft.

The device is particularly suited for use in applications where the downhole pump is a rotary pump which is driven by rotation of the rod string, but may also be used with some limitations in applications where the downhole pump is a reciprocating pump which is driven by reciprocation of the rod string.

The device may be used to couple the drive assembly with any apparatus which can be driven by rotation of the first shaft and the connector. Preferably, however, the apparatus is a tubing rotator for rotating a tubing string located in a wellbore.

The coupler may be comprised of any structure that is capable of transmitting rotation from the first shaft to the connector and which enables the driven end of the connector to rotate substantially coaxially with the first shaft. In the preferred embodiment, the driven end of the coupler is mounted about the first end of the first shaft such that the first end of the first shaft is contained therein, and the drive end of the coupler is mounted about the driven end of the connector such that the driven end of the connector is contained therein.

The connector may be comprised of any type of material that is capable of transmitting rotation of the first shaft to the apparatus. The connector may be rigid and may even comprise the first shaft itself or an extension of the first shaft. Preferably, however, the connector is comprised of a flexible second shaft, wherein the driven end of the second shaft is connectable with the drive end of the coupler so that the second shaft may be coupled with the first shaft, and wherein the drive end of the second shaft is connectable with the rotatable member of the apparatus so that the second shaft may be coupled with the apparatus. As a result, rotation of the first shaft will rotate the coupler which in turn will rotate the second shaft to drive the apparatus.

In the preferred embodiment, the connector is comprised of a flexible second shaft having a driven end and a drive end and is further comprised of a third shaft having a driven end and a drive end, such that the driven end of the third shaft is connected with the drive end of the coupler, the drive end of the third shaft is connected with the driven end of the second shaft, and the drive end of the second shaft is connectable with the rotatable member of the apparatus.

In the preferred embodiment, the device further comprises a housing mounted about the third shaft such that at least the drive end of the third shaft is contained within the housing and such that the third shaft is rotatable within the housing while the housing remains stationary. The device may in the preferred embodiment further comprise a flexible casing mounted with the housing and about the second shaft such that the second shaft is rotatable within the flexible casing while the flexible casing remains stationary. Preferably, in the preferred embodiment where the device comprises the housing, the device further comprises at least one support bearing located between the third shaft and the housing to rotatably support the third shaft in the housing.

For some applications of the device, such as in the preferred embodiment where the apparatus is a tubing rotator, the connector preferably further comprises means, associated with the second shaft, for creating a mechanical advantage to facilitate the generation of sufficient torque by the second shaft to rotate the rotatable member of the apparatus in order to drive the apparatus. Preferably, the mechanical advantage creating means is comprised of at least one set of gears.

The first shaft is either part of the drive assembly or it is connectable directly or indirectly with the drive assembly. In either case, the only essential requirements of the design of the first shaft are that it be rotatable and that it provide a first end to which the connector can be connected with the coupler.

In the preferred embodiment, the downhole pump is driven by rotation of the rod string and the drive assembly is further comprised of a power unit comprising a rotatable drive shaft and a motor for rotating the drive shaft and is further comprised of a primary transmission assembly for transmitting rotation from the drive shaft to the rod string such that rotation of the drive shaft rotates the rod string.

The first shaft may be part of the drive assembly, in which case it may comprise an end of the drive shaft, an extension of the drive shaft, an end of the rod string or an extension of the rod string. The first shaft may also be connectable either directly or indirectly with the drive assembly, in which case it is comprised of a separate shaft from either the drive shaft or the rod string. Where the first shaft is a separate shaft connected with the drive assembly, it may be rotated either by the power unit, the rod string, or by the primary transmission assembly.

In the preferred embodiment, the first shaft is a separate shaft connectable with the drive assembly and the device further comprises a secondary transmission assembly for transmitting rotation from the drive assembly to the first shaft. The secondary transmission assembly may be associated with the power unit, the rod string or with the primary transmission assembly. If the secondary transmission assembly is associated with the power unit, the first shaft is rotatably connected with the power unit and is rotated thereby. If the secondary transmission assembly is associated with the rod string, the first shaft is rotatably connected with the rod string and is rotated thereby. If the first shaft is associated with the primary transmission assembly, the first shaft is rotatably connected with the primary transmission assembly and is rotated thereby. The secondary transmission assembly may be comprised of any structure that is capable of transmitting rotation from the drive assembly to the first shaft, including intermeshing gears or a pulley with an associated rope, chain or belt.

In the preferred embodiment, the first shaft is comprised of a secondary driven pulley and is rotated either by the drive shaft or by the rod string. Where the first shaft is rotated by the drive shaft, the drive shaft is comprised of a secondary drive pulley. Where the first shaft is rotated by the rod string, the rod string is comprised of a secondary drive pulley. In either case, the secondary transmission assembly comprises the secondary driven pulley, the secondary drive pulley and at least one secondary belt extending between the secondary drive pulley and the secondary driven pulley for transmitting rotation therebetween.

BRIEF DESCRIPTION OF DRAWINGS

Embodiments of the invention will now be described with reference to the accompanying drawings, in which:

FIG. 6 is a top view of the secondary drive pulley shown in FIG. 4;

FIG. 7 is a cross-sectional view of the secondary drive pulley taken along line 7—7 of FIG. 6;

DETAILED DESCRIPTION

Figure 1:
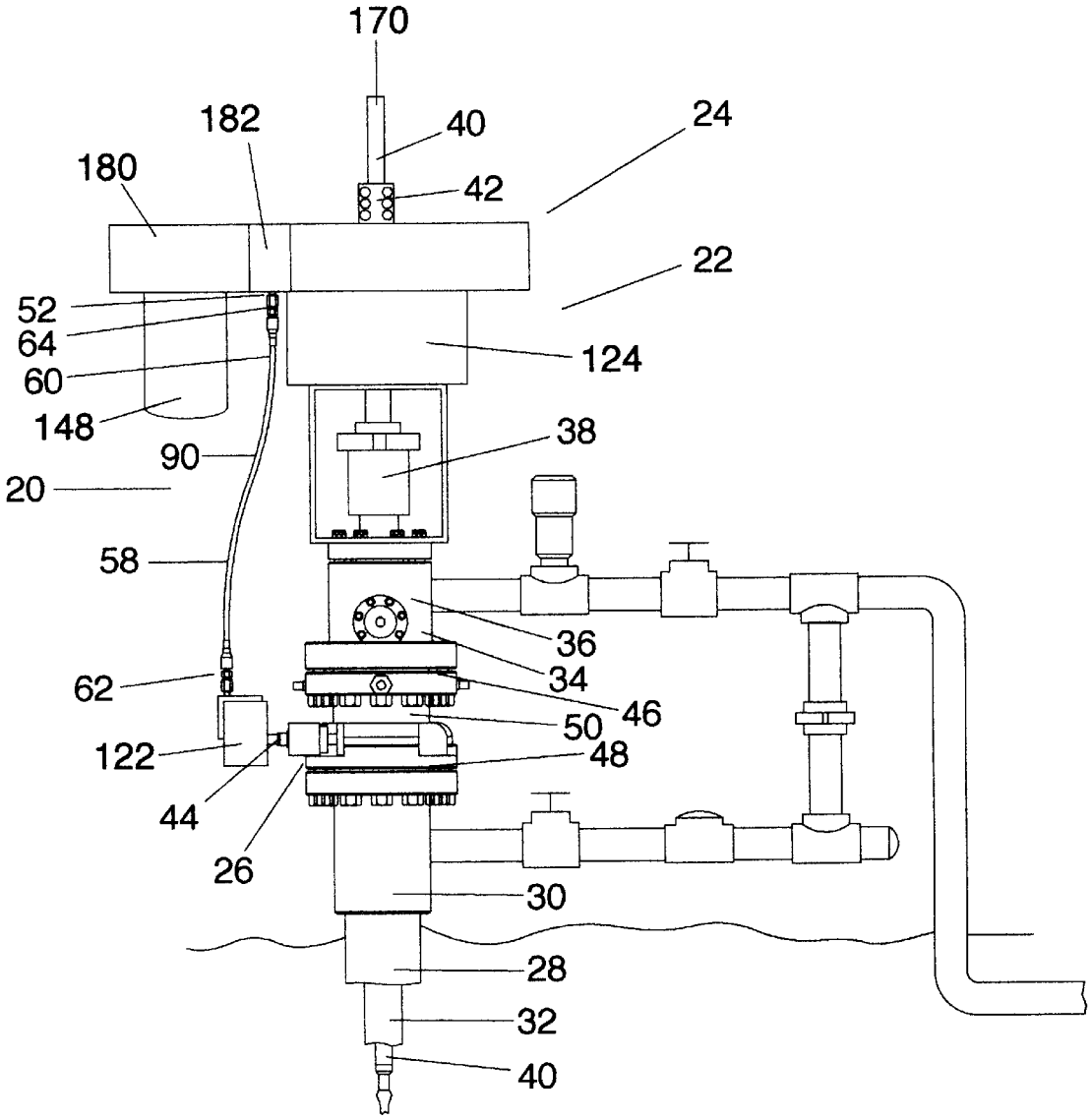
FIG. 1 is a side view of a wellhead including a drive assembly for a downhole pump, in which a preferred embodiment of the device is mounted for operation.
Figure 2:
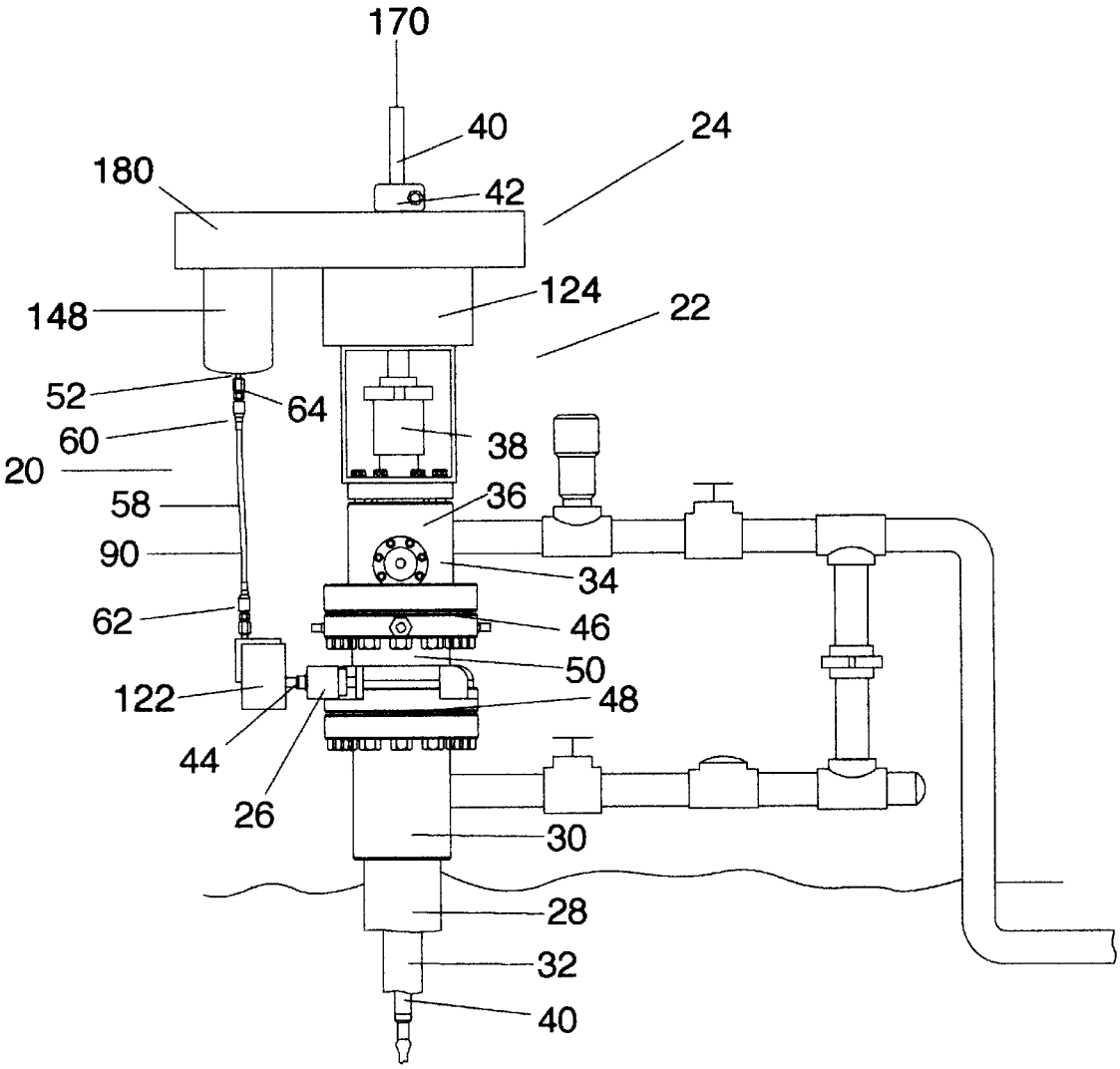
FIG. 2 is a side view of a wellhead including a drive assembly for a downhole pump, in which an alternate embodiment of the device is mounted for operation.

Referring to FIGS. 1 and 2, the invention is comprised of a device (20) for connection to a wellhead (22), wherein the wellhead includes a drive assembly (24) for a downhole pump. In particular, the device (20) is for coupling the drive assembly (24) with an apparatus (26) such that the drive assembly drives the apparatus (26).

A typical wellhead (22) is comprised of a plurality of components mounted at the ground surface above a wellbore. First, a typical wellhead may be comprised of a casing head or a casing bowl which engages or is otherwise mounted to a casing string (28) contained within the wellbore of the well at the surface. A tubing head or tubing bowl (30) may be mounted upon the upper surface of the casing head to provide a support mechanism for a tubing hanger. The tubing hanger is connected to or engages the upper end of a tubing string (32) which is contained within the wellbore. Alternately, as shown in FIGS. 1 and 2, the wellhead (22) may not include a casing head. In this case, the tubing head (30) is typically mounted directly to the casing string (28) at the surface of the well. The other portions of the wellhead (22) are then mounted above the tubing head (30).

A typical wellhead is also further comprised of a blowout preventer (34), a flow tee (36), which may be integral with the blowout preventer (34) as shown in FIGS. 1 and 2, and a stuffing box (38). Where the well includes a progressive cavity downhole pump, the wellhead (22) also includes the drive assembly (24) for the downhole pump. The drive assembly (24) is comprised of a rod string (40) rotatably suspended in the wellhead (22), as described further below.

The rod string (40) is run through the wellhead (22) and into the wellbore through a continuous fluid passage or pathway which extends through each of the components of the wellhead (22). The upper end of the rod string (40) is held by a clamp (42) such that the rod string (40) is suspended in the wellhead (22) and the wellbore. The rod clamp (42) is supported by the drive assembly (24) as detailed in FIG. 3 and as described further below. The downhole pump is attached to the lower end of the rod string (40) in the wellbore. Referring to FIGS. 1 and 2, in the preferred embodiment, the well is produced by rotating the rod string (40) in the wellbore. Thus, the drive assembly (24) drives the downhole pump by rotation of the rod string (40) at the surface.

As stated, the device is for coupling the drive assembly (24) with an apparatus (26). The apparatus (26) is comprised of a rotatable member (44) for driving the apparatus (26). As a result, the drive assembly (24) causes the rotation of the rotatable member (44), which in turn, acts to drive the apparatus (26). The apparatus (26) may be any apparatus or device which has a rotatable member (44) for driving the apparatus. However, preferably, the apparatus (26) comprises a portion of the wellhead (22) or, in other words, is comprised of a device or apparatus which typically forms a part of a wellhead (22). In the preferred embodiment, the apparatus (26) is preferably comprised of a tubing rotator forming part of the wellhead (22) as shown in FIGS. 1 and 2.

An upper end (46) of the tubing rotator (26) is preferably connected to the other components of the wellhead (22) or other wellhead equipment by any fastening or connecting means, mechanism, structure or device suitable for fastening or connecting the tubing rotator (26) to such other wellhead equipment. Thus, the further wellhead equipment, as detailed above, including the drive assembly (24), may be mounted upon the tubing rotator (26). Specifically, the upper end (46) of the tubing rotator (26) is preferably connectable directly or indirectly to the integral blowout preventer (34) and flow tee (36). Any manner of adapting, or any structure, device or mechanism for adapting, the upper end (46) of the tubing rotator (26) for connection to the other wellhead equipment may be used.

Similarly, a lower end (48) of the tubing rotator (26) is preferably connectable to the casing string (28), the casing head, the tubing head (30) as shown in FIGS. 1 and 2 or any other suitable components of the wellhead (22), or wellhead equipment. Any means, structure, device or mechanism suitable for mounting the tubing rotator (26) to the particular wellhead structure may be used as long as it is compatible with the function and purpose of the tubing rotator (26) and the device (20).

The tubing rotator (26) is comprised of the rotatable member (44) for driving the tubing rotator (26). Thus, the tubing rotator (26) may be any conventional tubing rotator (26) which includes a rotatable member (44) for driving the tubing rotator (26).

Preferably, the tubing rotator (26) is further comprised of a swivel tubing hanger (50) and a drive gear drivingly connected with the rotatable member (44). Any swivel tubing hanger (50) compatible with its use as described herein may be used. The swivel tubing hanger (50) is for connecting to the tubing string (32) such that the tubing string (32) is rotatably suspended thereby within the wellbore. Further, the tubing hanger (50) includes a driven gear which is compatible with the drive gear. Thus, the driven gear and the drive gear comprise the drive system of the tubing rotator (26) which causes the tubing string (32) connected to the tubing hanger (50) to be rotated within the wellbore. In particular, rotation of the rotatable member (44) drives the drive gear, which acts on the driven gear of the tubing hanger (50), in order to rotate the tubing hanger (50).

In the preferred embodiment, the tubing hanger (50) is further comprised of a supporting member and a supported member or mandrel rotatably supported within the supporting member. The supporting member may be comprised of any members, elements, structure, device, apparatus or mechanism suitable for rotatably supporting the supported member such that the tubing string (32) connected to the supported member may be rotatably supported within the wellbore. As well, the supporting member may rotatably support the supported member in any manner or by any means or mechanism suitable for performing this intended function.

In the preferred embodiment, the supporting member is tubular to rotatably support the supported member therein. As well, the supported member is tubular such that a bore of the supported member permits the passage of the rod string (40) and wellbore fluids therethrough. Preferably, the supported member is rotatably supported within the supporting member by at least one bearing located between the supported member and the supporting member such that the bearing is seated on the supporting member and the supported member is rotatably supported upon the bearing. Any bearing suitable for, and compatible with, this intended purpose or function may be used.

Further, the supported member is associated with the driven gear such that rotation of the driven gear causes the supported member to rotate within the supporting member. Any structure, device, mechanism or means for associating the supported member and the driven gear in the described manner may be used. However, preferably, the driven gear is fixedly mounted or connected about the supported member for engagement with the drive gear. The driven gear may be mounted or otherwise fastened to the supported member by any suitable means, structure, device or mechanism for mounting or fastening the driven gear thereto.

As stated, the drive system of the tubing rotator (26) is comprised of the drive gear and the driven gear. The drive gear and the driven gear may be comprised of any gears capable of performing the functions or purposes set herein, and which permit the drive gear and the driven gear to engage each other. For instance, the drive gear may be comprised of a worm and the driven gear may be comprised of a worm gear. Alternately, the drive gear may be comprised of a pinion and the driven gear may be comprised of a crown gear. As stated, the drive gear is connected with the rotatable member (44) such that the rotatable member (44) drives the drive gear. Preferably, the rotatable member (44) is comprised of a shaft rotatable about its longitudinal axis. One end of the shaft is connected with the drive gear. The other end of the shaft is connectable, directly or indirectly, with the device (20).

Figure 3:
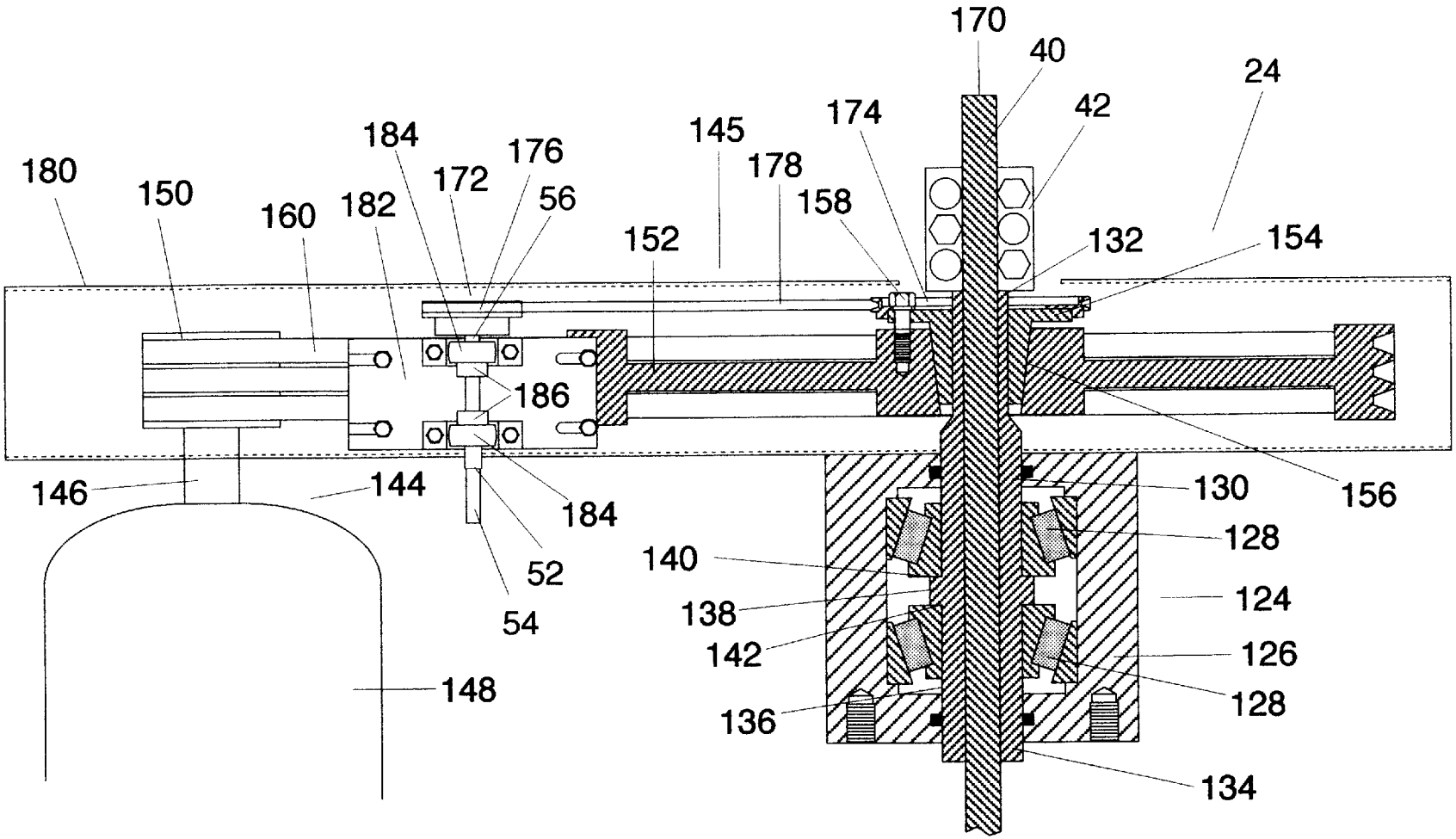
FIG. 3 is a longitudinal sectional view of the drive assembly shown in FIG. 1, wherein a portion of the device shown in FIG. 1, comprising a preferred embodiment of a secondary transmission assembly, is connected therewith for operation.
Figure 9:
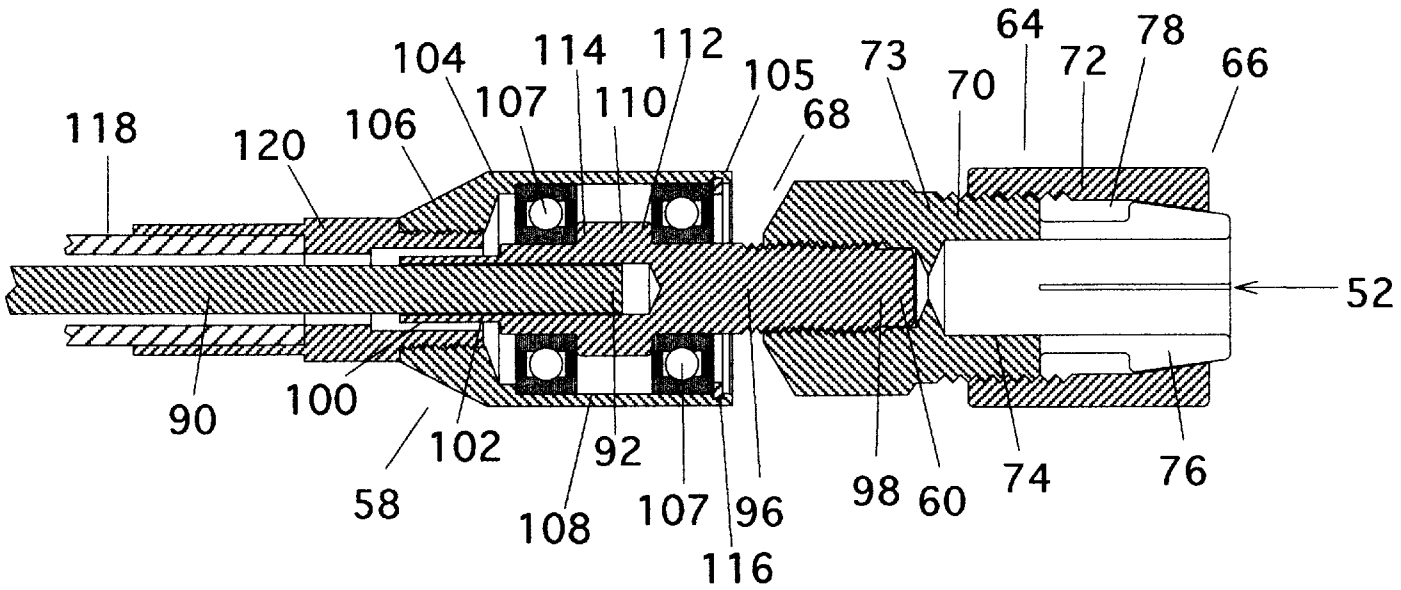
FIG. 9 is a longitudinal sectional view of the portion of the device shown in FIG. 8.
Figure 8:
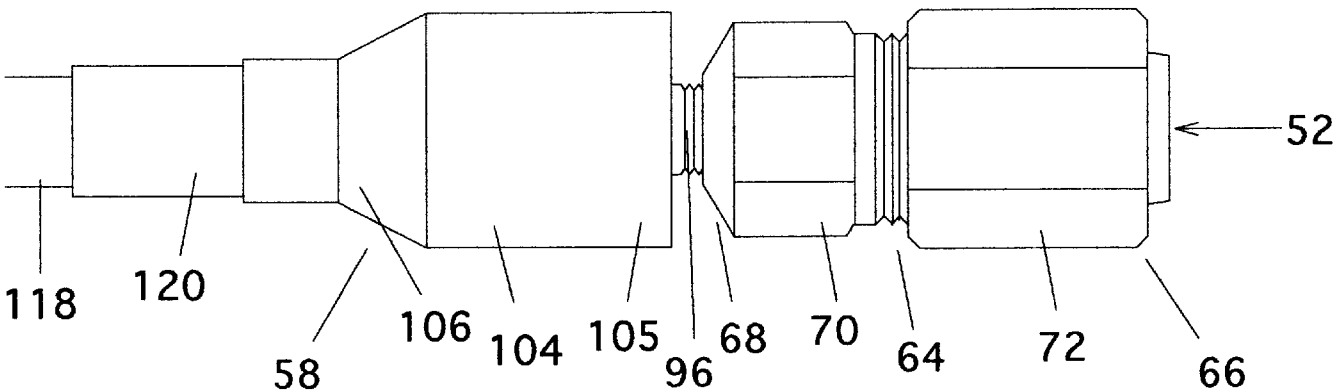
FIG. 8 is a side view of a portion of the device shown in FIG. 1, showing a coupler and an end of a connector comprising the device.

The device (20) operatively engages the drive assembly (24) for the downhole pump with the apparatus (26), preferably the tubing rotator. Referring to FIGS. 3 and 8–9, the device (20) is comprised of a rotatable first shaft (52) having a first end (54), a second end (56) and a longitudinal axis extending therebetween. The first shaft (52) is associated with the drive assembly (24), as detailed further below, such that the first shaft (52) is rotated thereby. The first shaft (52) may be associated with the drive assembly (24) in any manner permitting the first shaft (52) to be rotated by the drive assembly (24).

Referring to FIGS. 8 and 9, the device (20) is further comprised of a connector (58) having a driven end (60) and a drive end (62), wherein the driven end (60) defines a longitudinal axis therethrough. The connector (58) is for connecting the first shaft (52) with the rotatable member (44) of the apparatus (26) such that rotation of the first shaft (52) rotates the connector (58) and drives the apparatus (26). The connector (58) may connect the first shaft (52) with the rotatable member (44) in any manner such that rotation of the connector (58) rotates the rotatable member (44). However, preferably, the drive end (62) of the connector (58) is connectable with the rotatable member (44) and the driven end (60) is connectable with the first end (54) of the first shaft (52).

Finally, the device (20) is further comprised of a coupler (64) having a driven end (66), a drive end (68) and a longitudinal axis extending therebetween. The coupler (64) is for connecting the first shaft (52) with the connector (58).

The coupler (64) may couple or connect the first shaft (52) with the connector (58) in any manner such that rotation of the first shaft (52) rotates the connector (58). However, preferably, the longitudinal axis of the first shaft (52) is substantially co-axial with the longitudinal axis of the coupler (64) such that the driven end (60) of the connector (58) rotates substantially coaxially with the first shaft (52). The coupler (64) may be comprised of any means, device, apparatus, mechanism or structure able to connect or couple the first shaft (52) with the connector (58) such that rotation of the first shaft (52) rotates the connector (58) in the described manner.

In the preferred embodiment, the driven end (66) of the coupler (64) is connected with the first end (54) of the first shaft (52). The drive end (68) of the coupler (64) is connected with the driven end (60) of the connector (58). The driven and drive ends (66, 68) of the coupler (64) may be connected with the first shaft (52) and the connector (58) respectively by any means, device, apparatus, mechanism or structure able to connect or couple the driven and drive ends (66, 68) of the coupler (64) with the first shaft (52) and the connector (58) respectively such that rotation of the first shaft (52) rotates the connector (58). However, preferably, the driven end (66) of the coupler (64) is mounted about the first end (54) of the first shaft (52) such that the first end (54) of the first shaft (52) is contained within the coupler (64).

In the preferred embodiment, the coupler (64) is comprised of a collet body (70) and a collet nut (72). The collet body (70) comprises the driven end (66) and the drive end (68) of the coupler (64). Further, the collet body (70) defines an outer surface (73) and a bore (74) extending therethrough between the driven and drive ends (66, 68) of the collet body (70). The first shaft (52) is slidingly received within the driven end (66) of the collet body (70) for connection with the collet body (70). A moveable or flexible portion (76) of the collet body (70) adjacent the driven end (66) is moveable into and out of close engagement with the first end (54) by operation of the collet nut (72) as described below. The flexible portion (76) is comprised of two or more arms extending outwardly from the remainder of the collet body (70). Upon movement of the flexible portion (76) or arms into close engagement with the first end (54), the first end (54) is maintained in a fixed position relative to the collet body (70), and thus, the coupler (64). Therefore, rotation of the first shaft (52) causes rotation of the coupler (64).

The collet nut (72) defines a bore (78) which is threadably engaged with the outer surface (73) of the collet body (70) in a manner such that the bore (78) of the collet nut (72) acts upon the flexible portion (76) of the collet body (70). In particular, threading of the collet nut (72) onto the collet body (70) causes the flexible portion (76) or arms to move into close engagement with the first shaft (52) as a result of a wedging action between the bore (78) of the collet nut (72) and the outer surface (73) of the collet body (70).

The drive end (68) of the collet body (70) is preferably mounted about the driven end (60) of the connector (58) such that the driven end (60) of the connector (58) is contained within the coupler (64), and in particular, the collet body (70). In the preferred embodiment, a threaded connection is provided between the bore (74) of the collet body (70) at the drive end (68) and the driven end (60) of the connector (58).

Figure 10:
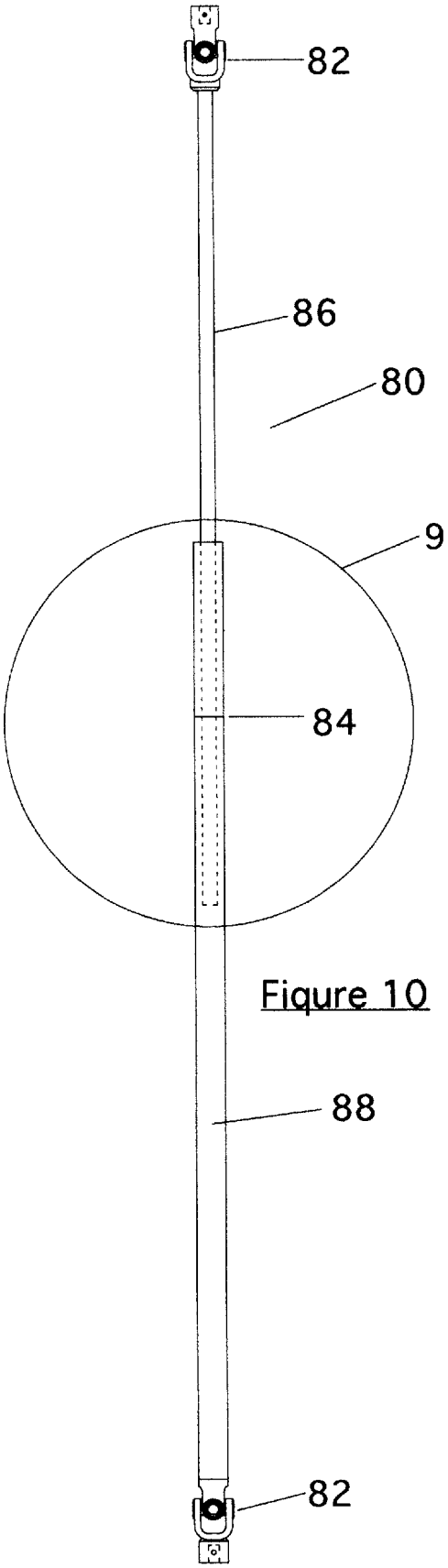
FIG. 10 is a side view of a portion of the device shown in FIG. 1, showing an alternate embodiment of the connector, wherein the connector is comprised of a power take off shaft having a slip joint portion.
Figure 12:
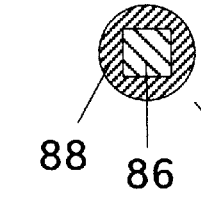
FIG. 12 is a cross-sectional view of the slip joint portion of the power take off shaft taken along line 12—12 of FIG. 11.
Figure 11:
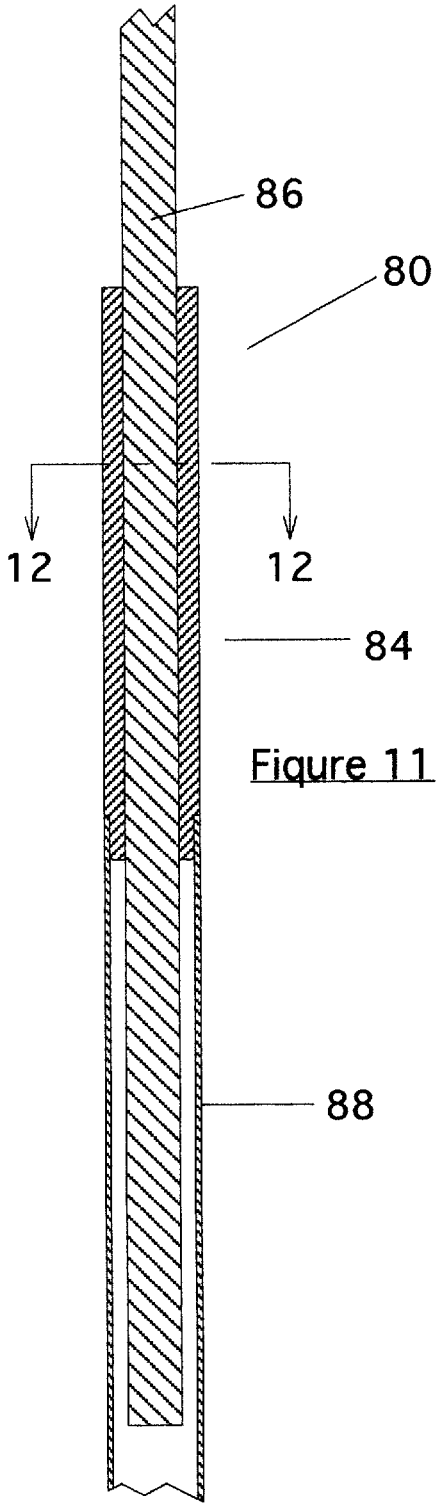
FIG. 11 is a longitudinal sectional view of the slip joint portion of the power take off shaft shown in FIG. 10.

The connector (58) may be comprised of any means, mechanism, device or structure for connecting the first shaft (52) with the rotatable member (44) of the apparatus (26) such that rotation of the first shaft (52) rotates the connector (58) and drives the apparatus (26). For instance, referring to FIGS. 10–12, the connector (58) may be comprised of a conventional power take off shaft (80). In this case, the power take off shaft (80) comprises the driven end (60) and the drive end (62) of the connector (58). More particularly, a universal joint (82) is preferably associated with each of the driven and drive ends (60, 62) for connection to the first shaft (52) and the rotatable member (44) respectively. Further, the power take off shaft (80) comprises a slip joint (84) located between the universal joints (82). The slip joint (84) permits longitudinal movement between an upper portion (86) and a lower portion (88) of the power take off shaft (80) to accommodate different length requirements of the connector (58).

Alternately, the connector (58) may be comprised of a flexible second shaft (90) having a driven end (92) and a drive end (94). Preferably, the driven end (92) of the flexible second shaft (90) is connectable with the coupler (64), preferably the drive end (68). As a result, rotation of the coupler (64) rotates the second shaft (90). Further, the drive end (94) of the second shaft (90) is connectable with the rotatable member (44) such that rotation of the second shaft (90) drives the apparatus (26).

However, in the preferred embodiment as shown in FIG. 9, the connector (58) is comprised of the flexible second shaft (90) and a third shaft (96). The third shaft (96) has a driven end (98), a drive end (100) and a longitudinal axis extending therebetween. The driven end (98) of the third shaft (96) is threadably connected with the drive end (68) of the coupler (64), as described above, such that rotation of the coupler (64) rotates the third shaft (96). The drive end (100) of the third shaft (96) is connected with the driven end (92) of the flexible second shaft (90) such that rotation of the third shaft (96) rotates the second shaft (90). Finally, the drive end (94) of the second shaft (90) is connectable with the rotatable member (44) such that rotation of the second shaft (90) drives the apparatus (26).

Any means, mechanism, device or structure may be used to connect the respective ends (100, 92) of the third and second shafts (96, 90). However, preferably, the drive end (100) of the third shaft (96) is mounted about the driven end (92) of the second shaft (90) such that the driven end (92) of the second shaft (90) is contained within the third shaft (96). Any connection, including a threaded connection, therebetween may be used, However, in the preferred embodiment, the drive end (100) of the third shaft (96) defines a bore (102) which is square on cross-section. The driven end (92) of the second shaft (90) is compatible with the bore (102) and is also preferably square on cross-section such that the second shaft (90) is rotationally fixed within the bore (102).

Further, in the preferred embodiment, the device (20) is further comprised of a housing (104), as shown in FIGS. 8 and 9, having a first end (105) and a second end (106). The housing (104) may be mounted about any or all of the first shaft (52), the third shaft (96) and the second shaft (90). However, in the preferred embodiment, the housing (104) is mounted about the third shaft (96) such that at least the drive end (100) of the third shaft (96) is contained within the housing (104).

Further, the housing (104) is preferably mounted about the third shaft (96) such that the third shaft (96) is rotatable within the housing (104) while the housing (104) remains stationary. Accordingly, in the preferred embodiment, at least one, and preferably two, support bearings (107) are located between the third shaft (96) and an inner surface (108) of the housing (104). Any suitable bearings (107) may be used. However, in the preferred embodiment, the bearings (107) are comprised of sealed ball bearings.

More particularly, the third shaft (96) includes a shoulder (110) adjacent or proximate to the drive end (100) of the third shaft (96). One bearing (107) is located between an upper surface (112) of the shoulder (110) and the first end (105) of the housing (104). The bearing (107) is held in position by a snap ring (116) at the first end (105) of the housing (104). A second bearing (107) is located between a lower surface (114) of the shoulder (110) and the second end (106) of the housing (104). This bearing (107) is held in position by the configuration of the housing (104) at its second end (106).

As well, a flexible casing (118) is preferably mounted with the housing (104) and about the second shaft (90) such that the second shaft (90) is rotatable within the flexible casing (118) while the casing (118) remains stationary. In particular, the casing (118) is preferably comprised of a case ferrule (120) for connecting the casing (118) to the second end (106) of the housing (104). The casing (118) then extends from the case ferrule (120) preferably along the entire length of the second shaft (90). However, the casing (118) may be connected to the housing (104) in any manner and the casing (118) may extend for any portion of the length of the second shaft (90).

Any means, mechanism, device or structure may be used to connect the drive end (94) of the second shaft (90)) with the rotatable member (44). However, in the preferred embodiment, the drive end (62) of the connector (58) is similar to the driven end (60) of the connector (58) such that the structure and configuration is similar. Further, the drive end (62) of the connector (58) is connected to the rotatable member (44) using a coupler (64) similar to the coupler (64) used to connect the first shaft (52) to the connector (58). In this case, the rotatable member (44) is received in the coupler (64) in place of the first shaft (52).

Further, where necessary, the connector (58) is preferably further comprised of means, associated with the second shaft (90), for creating a mechanical advantage to facilitate the generation of sufficient torque by the second shaft (90) to rotate the rotatable member (44) in order to drive the apparatus (26). Preferably, the mechanical advantage creating means is comprised of at least one set of gears (122). The gears are preferably connected between the rotatable member (44) and the drive end (94) of the second shaft (90). Thus, the drive end (94) of the second shaft (90) is connected to the gears (122) such that the second shaft (90) turns or rotates the gears (122). The gears (122) are connectable with the rotatable member (44) such that rotation of the gears (122) rotates the rotatable member (44) to drive the apparatus (26). Any arrangement or configuration of gears (122) able to facilitate the generation of the necessary torque may be used. However, preferably, the torque is stepped up by the gears (122) in stages to a level sufficient to rotate the rotatable member (44). In addition, where necessary, the mechanical advantage creating means may include a torque limiter (not shown) for limiting the torque generated by the connector (58) in order to inhibit the generation of torque sufficient to cause damage to the gears (122) or the apparatus (26).

The first shaft (52) may be associated, connected or mounted with the drive assembly (24) or be comprised of an existing portion of the drive assembly (24). In the preferred embodiment, the downhole pump is driven by rotation of the rod string (40). The drive assembly (24) is comprised of the rod string (40), which is rotatably suspended in the wellhead (22). In order to rotatably suspend the rod string (40) in the wellhead (22), the drive assembly (24) preferably includes a drive head (124).

The rod string (40) may be rotatably suspended in the wellhead (22) by any conventional structure, device or mechanism for performing this function. However, in the preferred embodiment, as shown in FIGS. 1 and 2, the drive head (124) includes a housing (126) which is mounted at the top of the wellhead (22), preferably above the stuffing box (38). The housing (126) has an upper end (125) and a lower end (127). The rod string (40) extends through the housing (126) from the lower end (125) to the upper end (127) and is rotatably supported therein by one or more thrust bearings (128).

More particularly, a sleeve (130) having a first end (132) and a second end (134) is fixedly mounted about the rod string (40) such that rotation of the rod string (40) correspondingly rotates the sleeve (13). Thus, the rod string (40) extends through the sleeve (13) from the second end (134) to the first end (132). The second end (134) of the sleeve (130) is rotatably suspended within the housing (126) by the thrust bearings (128). In particular, an outer surface (136) of the sleeve (130) defines a shoulder (138). One bearing (128) is located between an upper surface (140) of the shoulder (138) and the upper end (125) of the housing (126). A further bearing (128) is located between a lower surface (142) of the shoulder (138) and the lower end (127) of the housing (126).

The first end (132) of the sleeve (130) extends away from the upper end (125) of the housing (126). The rod clamp (42) is positioned about the rod string (40) at the first end (132) of the sleeve (130). When the rod clamp (42) is tightened about the rod string (40), the clamp (42) rests upon the first end (132) of the sleeve (130) and the rod string (40) is rotatably suspended thereby.

Further, the drive assembly (24) is preferably further comprised of a power unit (144) and a primary transmission assembly (145) for rotating the rod string (40). Any conventional power unit and transmission assembly or other device or apparatus for rotating the rod string (40) in the wellhead (22) may be used. However, the power unit (144) is preferably comprised of a rotatable drive shaft (146) and a motor (148) for rotating the drive shaft (146). Any conventional electric, hydraulic or internal combustion motor may be used. However, preferably the motor (148) is electric. The primary transmission assembly (145) transmits rotation from the drive shaft (146) to the rod string (40) such that rotation of the drive shaft (146) rotates the rod string (40).

The primary transmission assembly (145) may be comprised of any conventional means, device, apparatus, structure or mechanism for transmitting rotation from the drive shaft (146) to the rod string (40). For instance, the primary transmission assembly (145) may be comprised of a gear system between the drive shaft (146) and the rod string (40). In particular, a gear mounted about or comprising the drive shaft (146) may engage and mesh, directly or indirectly, with a gear mounted about or comprising the rod string (40). Alternately, the primary transmission assembly (145) may be comprised of a sprocket and chain assembly between the drive shaft 9146) and the rod string (40).

Figure 4:
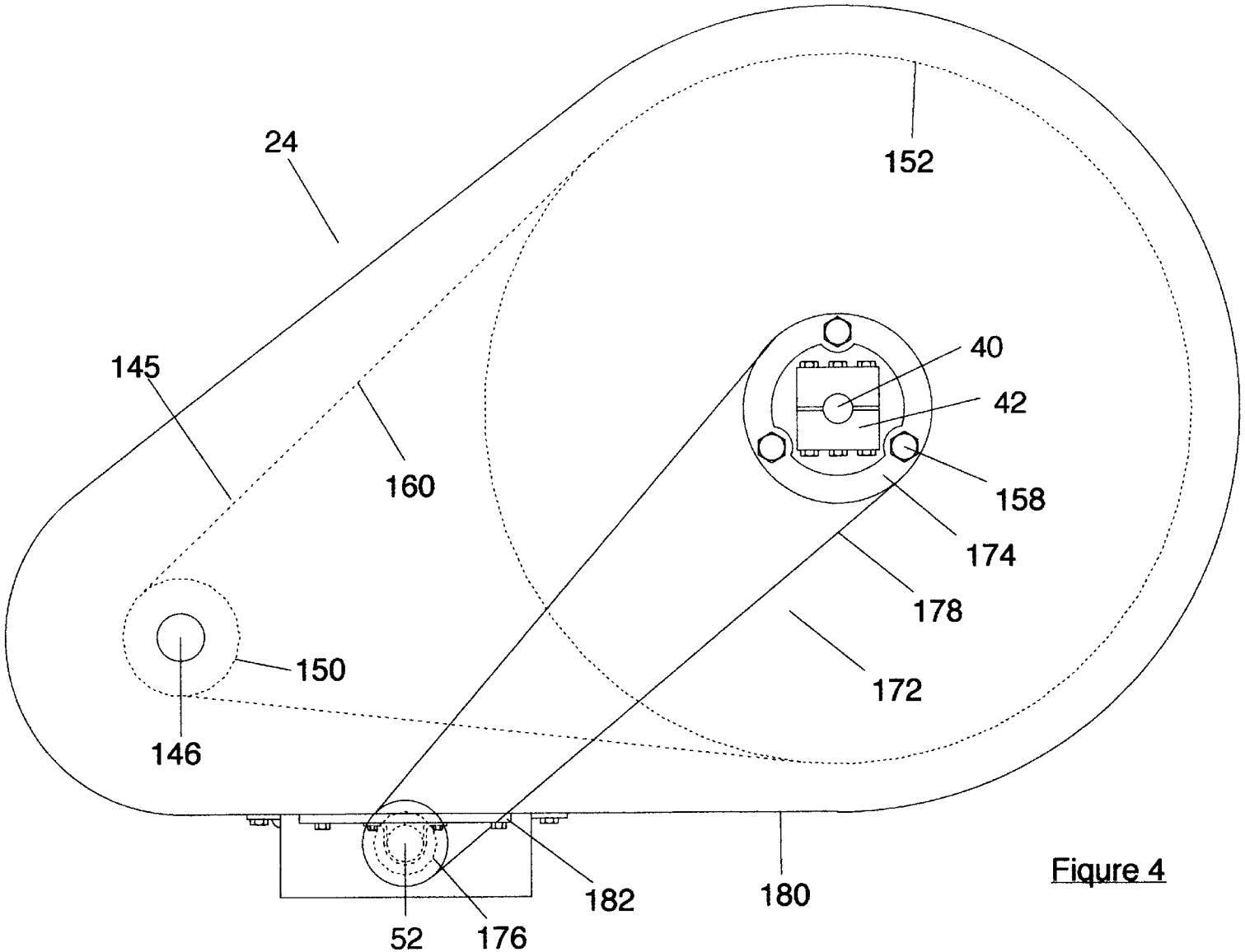
FIG. 4 is a top view of the drive assembly and the preferred secondary transmission assembly shown in FIG. 3, wherein the secondary transmission assembly includes a secondary drive pulley.

However, in the preferred embodiment, as shown in FIGS. 3 and 4, the primary transmission assembly (145) is comprised of a pulley and belt system. In particular, the primary transmission assembly (145) is comprised of a primary drive pulley (150) and a primary driven pulley (152). The primary drive pulley (150) is fixedly mounted with, or comprises, the drive shaft (146) such that rotation of the drive shaft (146) by the motor (148) causes rotation of the primary drive pulley (150). The primary driven pulley (152) is mounted with, or comprises, the rod string (40) such that rotation of the primary driven pulley (152) causes rotation of the rod string (40).

In particular, the primary driven pulley (152) is mounted with the first end (132) of the sleeve (130) by a split taper bushing (154). The primary driven pulley (152) defines a bore (156) therethrough such that the primary driven pulley (152) may be mounted about the first end (132) of the sleeve (130). When mounted, a space is provided between the bore (156) of the primary driven pulley (152) and the sleeve (130). The split taper bushing (154) is mounted about the first end (132) of the sleeve (130) such that at least a portion of the bushing (154) is placed within the space between the bore (156) of the primary driven pulley (152) and the sleeve (130). As a result of the shape and configuration of the adjacent surfaces of the bore (156) and the bushing (154), a wedging action causes the bushing (154) to be moved into close engagement with the sleeve (130) such that the bushing (154) is fixedly mounted therewith. The primary driven pulley (152) is further fastened to the bushing (154) by any suitable fasteners, such as screws or bolts (158).

Finally, the primary transmission system (145) is comprised of at least one belt (160), chain, rope or the like extending between the primary drive pulley (150) and the primary driven pulley (152) for transferring the rotation therebetween. As a result, rotation of the primary drive pulley (150) causes rotation of the primary driven pulley (152). In the preferred embodiment, 3 V-belts (160) are utilized.

The first shaft (52) may be associated, connected or mounted with any portion of, or any elements comprising, the drive assembly (24) such that the first shaft (52) is rotated thereby. For instance, the first shaft (52) may be associated, connected or mounted, directly or indirectly, with or be comprised of any elements of the primary transmission assembly (145). For example, the first shaft (52) may include a pulley which is directly or indirectly rotated by the V-belts (160).

Figure 5:
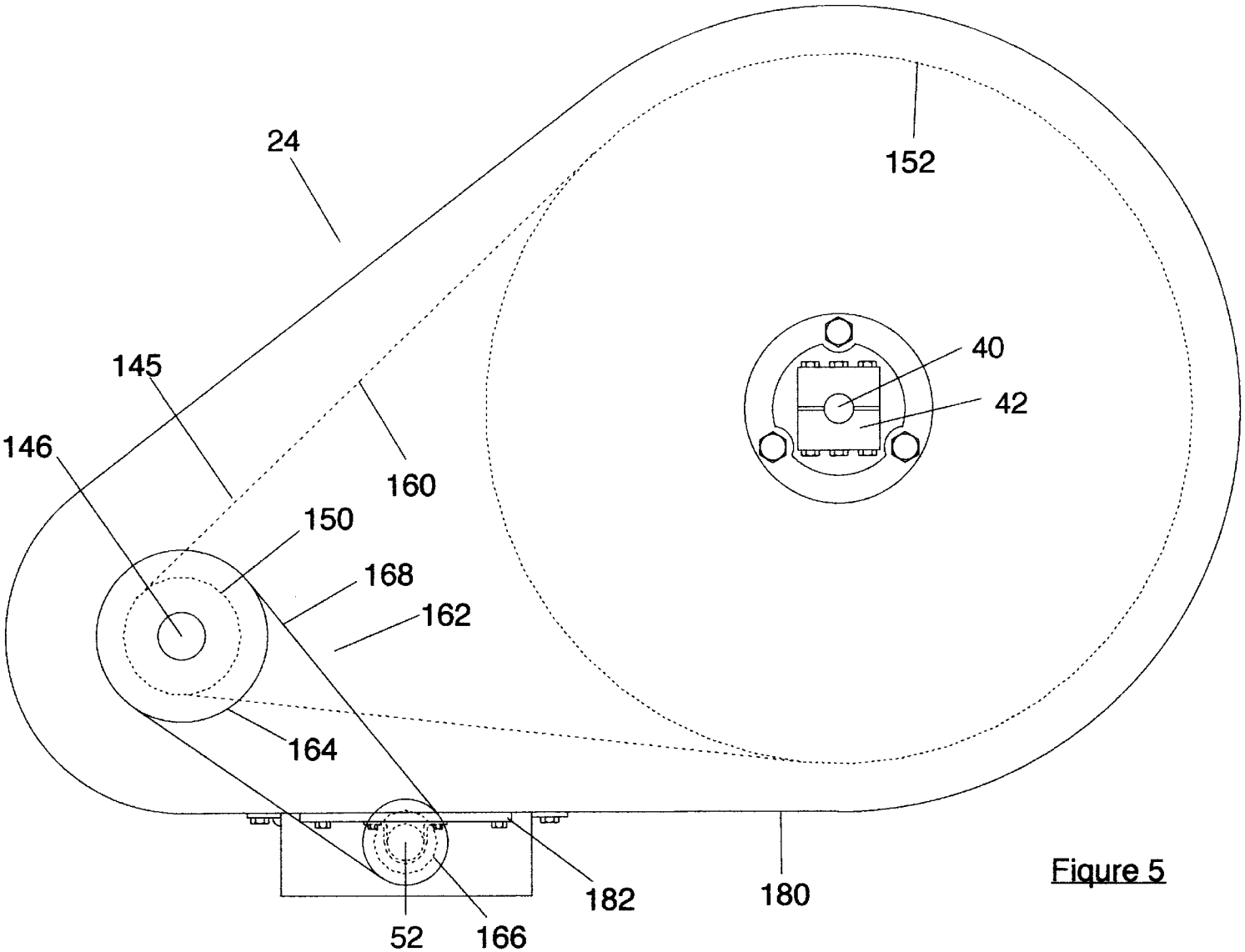
FIG. 5 is a top view of the drive assembly and an alternate embodiment of the secondary transmission assembly.

Alternately, as shown in FIGS. 2 and 5, the first shaft (52) may be rotated by the power unit (144). Specifically, as shown in FIG. 2, the first shaft (52) may be associated, connected or mounted, directly or indirectly, with or be comprised of the motor (148). The motor (148) may be comprised of the first shaft (52). Alternately, the first shaft (52) may be separately connected with the motor (148).

Further, as shown in FIG. 5, the first shaft (52) may be rotated by the drive shaft (146) comprising the power unit (144). The first shaft (52) may be associated, connected or mounted, directly or indirectly, with or be comprised of the drive shaft (146). In particular, the device (20) may be comprised of a secondary transmission assembly (162) associated with the power unit (144), and in particular, the drive shaft (146), for transmitting rotation from the drive shaft (146) to the first shaft (52).

The secondary transmission assembly (162) may be comprised of any conventional means, device, apparatus, structure or mechanism for transmitting rotation from the drive shaft (146) to the first shaft (52). For instance, the secondary transmission assembly (162) may be comprised of a gear system between the drive shaft (146) and the first shaft (52). In particular, a gear mounted about the drive shaft (146) may engage and mesh, directly or indirectly, with a gear mounted about the first shaft (52). Alternately, the secondary transmission assembly (162) may be comprised of a sprocket and chain assembly between the drive shaft (146) and the first shaft (52).

However, in a preferred alternate embodiment, as shown in FIG. 5, the secondary transmission assembly (162) is comprised of a pulley and belt system. In particular, the secondary transmission assembly (162) is comprised of a secondary drive pulley (164) and a secondary driven pulley (166). The secondary drive pulley (164) is fixedly mounted with or comprises the drive shaft (146) such that rotation of the drive shaft (146) by the motor (148) causes rotation of the secondary drive pulley (164). The secondary driven pulley (166) is mounted with or comprises the first shaft (52) such that rotation of the secondary driven pulley (166) causes rotation of the first shaft (52).

Finally, the secondary transmission assembly (162) is comprised of at least one belt (168), chain, rope or the like extending between the secondary drive pulley (164) and the secondary driven pulley (166) for transferring the rotation therebetween. As a result, rotation of the secondary drive pulley (164) causes rotation of the secondary driven pulley (166).

However, in the preferred embodiment of the device (20) as shown in FIGS. 1, 3 and 4, the first shaft (52) is rotated by the rod string (40). The first shaft (52) may be associated, connected or mounted, directly or indirectly, with or be comprised of the rod string (40). For instance, the rod string (40) may comprise the first shaft (52) such that the coupler (64) connects the rod string (40) with the connector (58). Alternately, the first shaft (52) may form an integral part of, or be mounted or connected with, the rod string (40), and in particular, the end (170) of the rod string (40).

However, in the preferred embodiment, the device (20) is further comprised of a secondary transmission assembly (172), similar to that described above, but associated with the rod string (40) for transmitting rotation from the rod string (40) to the first shaft (52).

Referring to FIGS. 3 and 4, the secondary transmission assembly (172) may be comprised of any conventional means, device, apparatus, structure or mechanism for transmitting rotation from the rod string (40) to the first shaft (52). For instance, the secondary transmission assembly (172) may be comprised of a gear system between the rod string (40) and the first shaft (52). In particular, a gear mounted about the rod string (40) may engage and mesh, directly or indirectly, with a gear mounted about the first shaft (52). Alternately, the secondary transmission assembly (172) may be comprised of a sprocket and chain assembly between the rod string (40) and the first shaft (52).

However, in a preferred embodiment, as shown in FIGS. 3 and 4, the secondary transmission assembly (172) is comprised of a pulley and belt system. In particular, the secondary transmission assembly (172) is comprised of a secondary drive pulley (174) and a secondary driven pulley (176). The secondary drive pulley (174) is fixedly mounted with or comprises the rod string (40) such that rotation of the rod string (40) by the drive assembly (24) causes rotation of the secondary drive pulley (174). The secondary driven pulley (176) is mounted with or comprises the first shaft (52) such that rotation of the secondary driven pulley (176) causes rotation of the first shaft (52).

Referring to FIG. 3, in the preferred embodiment, the secondary drive pulley (174) is mounted with the split taper bushing (154) and fastened thereto by means of the bolts (158) used to secure the primary driven pulley (152). However, the secondary drive pulley (174) may be mounted or connected with the rod string (40) in any other suitable manner and by any other suitable means, mechanism, device or apparatus which fixedly mounts the secondary drive pulley (174) thereto for rotation therewith. Preferably, as shown in FIG. 4, the manner of mounting the secondary drive pulley (174) permits the secondary drive pulley (174) to be mounted without removing the clamp (42) from the rod string (40). As shown in FIG. 4, the secondary drive pulley (174) may be mounted over the clamp (42) and secured to the bushing (154) without releasing the rod string (40).

The secondary transmission assembly (172) is comprised of at least one belt (178), chain, rope or the like extending between the secondary drive pulley (174) and the secondary driven pulley (176) for transferring the rotation therebetween. As a result, rotation of the secondary drive pulley (174) causes rotation of the secondary driven pulley (176). In the preferred embodiment, one V-belt (178) is utilized.

Finally, in the preferred embodiment, as shown in FIGS. 3 and 4, the first shaft (52), which is comprised of the secondary driven pulley (176), is mounted to a belt guard (180) surrounding the primary transmission assembly (145). As shown in FIG. 3, the first shaft (52) is mounted to the belt guard (180) by a mounting plate (182). More particularly, the first shaft (52) is rotatably secured by two bearing blocks (184) held in position by two corresponding set collars (186). As a result, the rotatable first shaft (52) extends from the first end (54), through the bearing blocks (184) to the second end (56). The secondary driven pulley (176) is mounted with or comprises the second end (56). However, the first shaft (52) may be rotatably mounted in any other suitable location or position permitting the secondary transmission assembly (172) to operate as described herein. Further, the first shaft (52) may be mounted by any other suitable device, apparatus, structure or mechanism permitting the first shaft (52) to rotate therein.

What is claimed is:

1. A device for connection to a wellhead for coupling a drive assembly for a downhole pump with an apparatus having a rotatable member for driving the apparatus, the drive assembly comprising a rod string suspended in the wellhead and wherein the drive assembly drives the downhole pump, the device comprising:

(a) a rotatable first shaft having a first end, a second end and a longitudinal axis extending therebetween, wherein the first shaft is associated with the drive assembly such that the first shaft is rotated thereby;

(b) a rotatable connector for connecting the first shaft with the rotatable member of the apparatus such that rotation of the first shaft rotates the connector and drives the apparatus, the connector comprising a driven end for connecting with the first end of the first shaft and a drive end for connecting with the rotatable member of the apparatus; and (c) a rotatable coupler having a driven end, a drive end and a longitudinal axis extending therebetween for connecting the first shaft with the connector, wherein the driven end of the coupler is connected with the first end of the first shaft, wherein the drive end of the coupler is connected with the driven end of the connector, wherein the longitudinal axis of the first shaft is substantially coaxial with the longitudinal axis of the coupler such that the driven end of the connector rotates substantially coaxially with the first shaft and wherein the coupler is mounted about at least one of the first end of the first shaft and the driven end of the connector such that at least one of the first end of the first shaft and the driven end of the connector is contained therein.

2. The device as claimed in claim 1 wherein the connector is comprised of a flexible second shaft, wherein the driven end of the second shaft is connectable with the drive end of the coupler such that rotation of the coupler rotates the second shaft and wherein the drive end of the second shaft is connectable with the rotatable member of the apparatus such that rotation of the second shaft drives the apparatus.

3. The device as claimed in claim 2 wherein the apparatus is comprised of a tubing rotator for rotating a tubing string within a wellbore, wherein the tubing rotator is comprised of the rotatable member for driving the tubing rotator such that the tubing string rotates within the wellbore.

4. The device as claimed in claim 2 wherein the downhole pump is driven by rotation of the rod string and wherein the drive assembly is further comprised of a power unit, the power unit comprising a rotatable drive shaft and a motor for rotating the drive shaft, and a primary transmission assembly for transmitting rotation from the drive shaft to the rod string such that rotation of the drive shaft rotates the rod string and wherein the first shaft is rotated by the power unit.

5. The device as claimed in claim 4 further comprising a secondary transmission assembly for transmitting rotation from the drive shaft to the first shaft.

6. The device as claimed in claim 5 wherein the first shaft is comprised of a secondary driven pulley, wherein the drive shaft is comprised of a secondary drive pulley and wherein the secondary transmission assembly comprises the secondary driven pulley, the secondary drive pulley and at least one secondary belt extending between the secondary drive pulley and the secondary driven pulley for transmitting rotation therebetween.

7. The device as claimed in claim 6 wherein the apparatus is comprised of a tubing rotator for rotating a tubing string within a wellbore, wherein the tubing rotator is comprised of the rotatable member for driving the tubing rotator such that the tubing string rotates within the wellbore.

8. The device as claimed in claim 2 wherein the downhole pump is driven by rotation of the rod string and wherein the drive assembly is further comprised of a power unit, the power unit comprising a rotatable drive shaft and a motor for rotating the drive shaft, and a primary transmission assembly for transmitting rotation from the drive shaft to the rod string such that rotation of the drive shaft rotates the rod string and wherein the first shaft is rotated by the rod string.

9. The device as claimed in claim 8 further comprising a secondary transmission assembly for transmitting rotation from the rod string to the first shaft.

10. The device as claimed in claim 9 wherein the first shaft is comprised of a secondary driven pulley, wherein the rod string is comprised of a secondary drive pulley and wherein the secondary transmission assembly comprises the secondary driven pulley, the secondary drive pulley and at least one secondary belt extending between the secondary drive pulley and the secondary driven pulley for transmitting rotation therebetween.

11. The device as claimed in claim 10 wherein the apparatus is comprised of a tubing rotator for rotating a tubing string within a wellbore, wherein the tubing rotator is comprised of the rotatable member for driving the tubing rotator such that the tubing string rotates within the wellbore.

12. The device as claimed in claim 1 wherein the connector is comprised of:

(a) a flexible second shaft having a driven end and a drive end, wherein the drive end of the second shaft is connectable with the rotatable member of the apparatus such that rotation of the second shaft drives the apparatus; and (b) a third shaft having a driven end and a drive end, wherein the driven end of the third shaft is connected with the drive end of the coupler such that rotation of the coupler rotates the third shaft and wherein the drive end of the third shaft is connected with the driven end of the second shaft such that rotation of the third shaft rotates the second shaft.

13. The device as claimed in claim 12 further comprising a housing mounted about the third shaft such that at least the drive end of the third shaft is contained within the housing and such that the third shaft is rotatable within the housing while the housing remains stationary.

14. The device as claimed in claim 13 further comprising a flexible casing mounted with the housing and about the second shaft such that the second shaft is rotatable within the flexible casing while the flexible casing remains stationary.

15. The device as claimed in claim 14 wherein at least one support bearing is located between the third shaft and the housing to rotatably support the third shaft in the housing.

16. The device as claimed in claim 15 wherein the apparatus is comprised of a tubing rotator for rotating a tubing string within a wellbore, wherein the tubing rotator is comprised of the rotatable member for driving the tubing rotator such that the tubing string rotates within the wellbore.

17. The device as claimed in claim 2 wherein the connector is further comprised of means, associated with the second shaft, for creating a mechanical advantage to facilitate the generation of sufficient torque by the second shaft to rotate the rotatable member of the apparatus in order to drive the apparatus.

18. The device as claimed in claim 17 wherein the mechanical advantage creating means is comprised of at least one set of gears.

19. The device as claimed in claim 18 wherein the apparatus is comprised of a tubing rotator for rotating a tubing string within a wellbore, wherein the tubing rotator is comprised of the rotatable member for driving the tubing rotator such that the tubing string rotates within the wellbore.

* * * * *